US010448466B2

(12) United States Patent
Gao

(10) Patent No.: US 10,448,466 B2
(45) Date of Patent: Oct. 15, 2019

(54) STEM STRUCTURE AND LED LIGHTING DEVICE

(71) Applicant: Katerra Inc., Menlo Park, CA (US)

(72) Inventor: Shanfu Gao, Shanghai (CN)

(73) Assignee: Katerra Inc., Menlo Park, CA (US)

( * ) Notice: Subject to any disclaimer, the term of this patent is extended or adjusted under 35 U.S.C. 154(b) by 0 days.

(21) Appl. No.: 16/197,003

(22) Filed: Nov. 20, 2018

(65) Prior Publication Data

US 2019/0166661 A1 May 30, 2019

(51) Int. Cl.
*H05B 33/08* (2006.01)

(52) U.S. Cl.
CPC ..... *H05B 33/0806* (2013.01); *H05B 33/0884* (2013.01)

(58) Field of Classification Search
CPC ..... H05B 33/0806; H05B 33/0884
USPC ..... 315/185 R
See application file for complete search history.

(56) References Cited

U.S. PATENT DOCUMENTS

| | | | | |
|---|---|---|---|---|
| 10,178,717 | B2 | 1/2019 | Seyler | |
| 2011/0227489 | A1 | 9/2011 | Huynh | |
| 2012/0299489 | A1 | 11/2012 | Huynh | |
| 2013/0162149 | A1 | 6/2013 | Vande Ven | |
| 2013/0249426 | A1 | 9/2013 | Tao | |
| 2013/0313991 | A1 | 11/2013 | Pan | |
| 2014/0175996 | A1 | 6/2014 | Yoon | |
| 2015/0043212 | A1* | 2/2015 | Coffey | F21K 9/237 362/294 |
| 2016/0341370 | A1* | 11/2016 | Dekker | F21V 29/004 |
| 2017/0138542 | A1* | 5/2017 | Gielen | F21K 9/232 |
| 2018/0363893 | A1* | 12/2018 | Cheng | F21V 29/70 |
| 2019/0120438 | A1* | 4/2019 | Wan | H05K 1/0209 |

* cited by examiner

*Primary Examiner* — Don P Lee
(74) *Attorney, Agent, or Firm* — Haverstock & Owens LLP

(57) ABSTRACT

The present invention comprises a stem structure and an LED lighting device, wherein the stem structure comprises a substrate, configured to be bent into a substrate device with a internal hollow structure, wherein a plurality of LED lamp beads and a plurality of pin needles are attached to a surface of the substrate device; a horn mouth comprising a first wide mouth portion and a first narrow mouth portion opposite to the first wide mouth portion, the first narrow mouth portion being provided with a plurality of upper guide wires for connecting to the plurality of pin needles; a plurality of lower guide wires, disposed inside the horn mouth, and configured to be connected to the plurality of upper guide wires through the first narrow mouth portion; and a glass tube disposed inside the horn mouth and attached to the plurality of lower guide wires; wherein the LED lighting device comprises a glass bulb, wherein a lamp head is disposed at an opening of the glass bulb; a driving circuit board fixedly connected to the lamp head with a collar, an input end of the driving circuit board being electrically connected to the lamp head; and the stem structure, disposed inside the glass bulb, and configured to be electrically connected to an output end of the driving circuit board through the lower guide wire. The technical solution has the following advantages: the stem structure and the LED lighting device have a simple structure, a low cost, a high pass rate, and they can withstand external force.

17 Claims, 4 Drawing Sheets

STEM STRUCTURE AND LED LIGHTING DEVICE

CROSS-REFERENCE TO RELATED APPLICATIONS

The present application claims priority to and the benefit of Chinese Patent Application No. CN 201721590995.7, filed on Nov. 24, 2017, the entire content of which is incorporated herein by reference.

BACKGROUND OF THE INVENTION

1. Field of the Invention

The invention relates to the field of LED lighting technology, and more particularly, to a stem structure and an LED lighting device.

2. Description of the Related Art

Appearing as one of the most promising products in the field of lighting industry, LEDs (Light Emitting Diode) are also referred to as a solid-state cold light source. Since LEDs are gradually replacing incandescent light sources and fluorescent light sources due to its many advantages, such as high efficiency, low energy consumption, long lifetime, small size, quick response, non-pollution and simple maintenance. Therefore, LEDs are an emerging industry of great strategic significance. The lighting ecosystem of LED lighting is reshaping gradually, LEDs is therefore called as the fourth generation light source or a green light source.

At present, there are two types of stem structures disposed inside glass bulb in the market, one type of which is made by arranging a guide wire in the center of the stem for prevention of inclined placement and for welding positioning, and the other type of which is made by disposing a piece of glass in the bulb and bending the top substrate to get the glass stuck without any movement. However, in both cases, waggling may occur as well. If the stem structure is subject to external force, the substrate and the stem may be displaced and scratched, and a noise from bumping can be heard; or displacement of the stem and the substrate may result in crashing the glass wall, and breakage can be found on the top of the stem, thus, unqualified products are increased. In addition, the glass bulb itself is easy to be broken. All of the problems are a bottleneck for mass production of glass light source.

SUMMARY OF THE INVENTION

Aiming at the foregoing problems in the prior art, the present invention provides a stem structure and an LED lighting device, wherein the stem structure and the LED lighting device have a simple structure, a low cost, a high pass rate and they can withstand the external force.

The technical solution is as follows:

A stem structure comprising:

a substrate, configured to be bent into a substrate device with an internal hollow structure, wherein a plurality of LED lamp beads and a plurality of pin needles are attached to a surface of the substrate device;

a horn mouth comprising a first wide mouth portion and a first narrow mouth portion opposite to the first wide mouth portion, the first narrow mouth portion being provided with a plurality of upper guide wires for connecting to the plurality of pin needles;

a plurality of lower guide wires, disposed inside the horn mouth, and configured to be connected to the plurality of upper guide wires through the first narrow mouth portion; and a glass tube disposed inside the horn mouth and attached to the plurality of lower guide wires.

Preferable, the substrate device and the first wide mouth portion have a pad in a range from 28 mm to 55 mm.

Preferable, the substrate device is a polyhedral structure having at least four surfaces, and an air convection hole is disposed on the top of the substrate device, wherein the plurality of LED lamp beads are evenly attached to side surfaces and a top surface of the substrate device.

Preferable, the glass tube is integrally formed with the horn mouth, the plurality of upper guide wires and the plurality of lower guide wires by a sintering process.

Preferable, the number of the upper guide wire is at least three.

Preferable, the number of the plurality of pin needles is at least three, wherein two of the plurality of pin needles are connected to a positive electrode and a negative electrode of the plurality of LED lamp beads respectively, the remaining one of the plurality of pin needles which is not connected to the positive electrode and the negative electrode of the plurality of LED lamp beads is electrically neutral for supporting the stem structure.

Preferable, the three upper guide wires correspond to the three pin needles respectively, and are connected to the three pin needles by a butt welding process.

Preferable, the stem structure has a diameter in a range from 10 mm to 34 mm.

An LED lighting device comprising the above-mentioned stem structure comprising:

a glass bulb, wherein a lamp head is disposed at an opening of the glass bulb;

a driving circuit board fixedly connected to the lamp head with a collar, an input end of the driving circuit board being electrically connected to the lamp head; and the stem structure, disposed inside the glass bulb, and configured to be electrically connected to an output end of the driving circuit board through the lower guide wire.

Preferable, the glass bulb is designed such that the glass bulb is in the shape of an A-type glass bulb, or a B-type glass bulb, or an ST-type glass bulb, or a G-Type glass bulb, or a P-type glass bulb, or a BR type glass bulb.

The technical solution has the following advantages: providing a stem structure and an LED lighting device, wherein the stem structure and the LED lighting device have a simple structure, a low cost, a high pass rate, and they can withstand external force.

BRIEF DESCRIPTION OF THE DRAWINGS

The accompanying drawings, together with the specification, illustrate exemplary embodiments of the present disclosure, and, together with the description, serve to explain the principles of the present invention.

LIST OF REFERENCE NUMERALS FOR THE ABOVE DESCRIPTION

Figure 1:
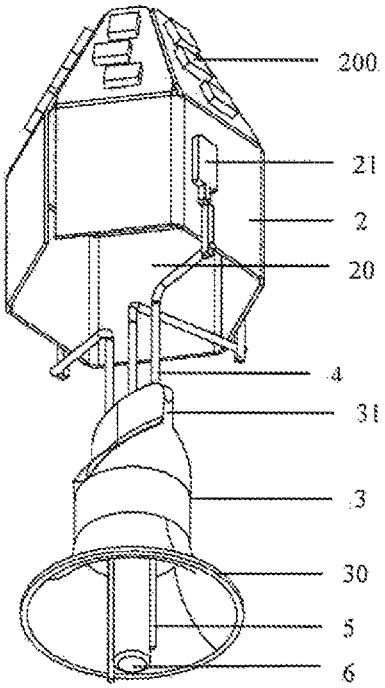
FIG. 1 is a schematic view showing an overall structure of a stem structure according to the present invention.

Stem structure (1); Substrate (20); LED lamp bead (200); Pin needle (21); Horn mouth (3); First wide mouth portion (30); First narrow mouth portion (31); Upper guide wire (4); Lower guide wire (5); Glass tube (6); Glass bulb (7); Lamp head (8); Collar (80); Driving circuit board (9).

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

As shown in FIG. 1, the present invention provides a stem structure 1, comprising:

a substrate 2, configured to be bent into a substrate device 20 with an internal hollow structure, wherein a plurality of LED lamp beads 200 and a plurality of pin needles 21 are attached to a surface of the substrate device 20;

a horn mouth 3 comprising a first wide mouth portion 30 and a first narrow mouth portion 31 opposite to the first wide mouth portion 30, the first narrow mouth portion 31 being provided with a plurality of upper guide wires 4 for connecting to the plurality of pin needles 21;

a plurality of lower guide wire 5, disposed inside the horn mouth 3, and configured to be connected to the plurality of upper guide wires 4 through the first narrow mouth portion 31; and a glass tube 6 disposed inside the horn mouth 3 and attached to the plurality of lower guide wires 5.

By using the above-mentioned technical solution, the substrate 2 is bent into a substrate device 20 with an internal hollow structure, a plurality of LED lamp beads 200 and a plurality of pin needles 21 are attached to a surface of the substrate device 20, such that an approximately hemispherical illuminator is formed; the pin needles 21 on the substrate device 20 are connected to the plurality of upper guide wires 4, the plurality of upper guide wires 4 are connected to the lower guide wires 5 through the first narrow mouth portion 31 of the horn mouth 3, and the lower guide wires 5 are disposed inside the horn mouth 3 and attached to the glass tube 6.

In a preferred embodiment, the substrate device 20 and the first wide mouth portion 30 have a pad in a range from 28 mm to 55 mm.

In a preferred embodiment, the substrate device 20 is a polyhedral structure having at least four surfaces, and an air convection hole 201 is disposed on the top of the substrate device 20, wherein the plurality of LED lamp beads 200 are evenly attached to side surfaces and a top surface of the substrate device 20.

In a preferred embodiment, the glass tube 6 is integrally formed with the horn mouth 3, the plurality of upper guide wires 4 and the plurality of lower guide wires 5 by a sintering process.

In a preferred embodiment, the number of the upper guide wire is at least three.

In a preferred embodiment, the number of the plurality of pin needles 21 is at least three, wherein two of the plurality of pin needles 21 are connected to a positive electrode and a negative electrode of the plurality of LED lamp beads 200 respectively, the remaining one of the plurality of pin needles 21 which is not connected to the positive electrode and the negative electrode of the plurality of LED lamp beads 200 is electrically neutral for supporting the stein structure 1.

In a preferred embodiment, the three upper guide wires 4 correspond to the three pin needles respectively, and are connected to the three pin needles 21 by a butt welding process.

In a preferred embodiment, the stein structure has a diameter in a range from 10 mm to 34 mm.

Figure 2:
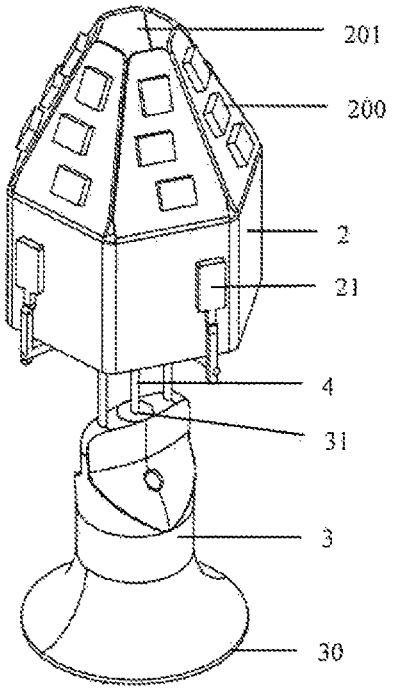
FIG. 2 is a top view showing the presence of a stem structure used in a BR-type glass bulb according to an embodiment of the present invention.

Specifically, in this embodiment, as shown in FIG. 2, the substrate device 20 is polyhedral structure having six surfaces, and an air convection hole 201 is disposed on the top of the substrate device 20 for effectively accelerating air convention inside the substrate device 20. In doing so, the internal heat dissipation can be effectively solved, and thus the utilization rate of the substrate device 20 is improved, and the lifetime is increased. In addition, the plurality of LED lamp beads 200 are evenly attached to side surfaces and a top surface of the substrate device 20, so as to form an approximately hemispherical illuminator.

Figure 3:
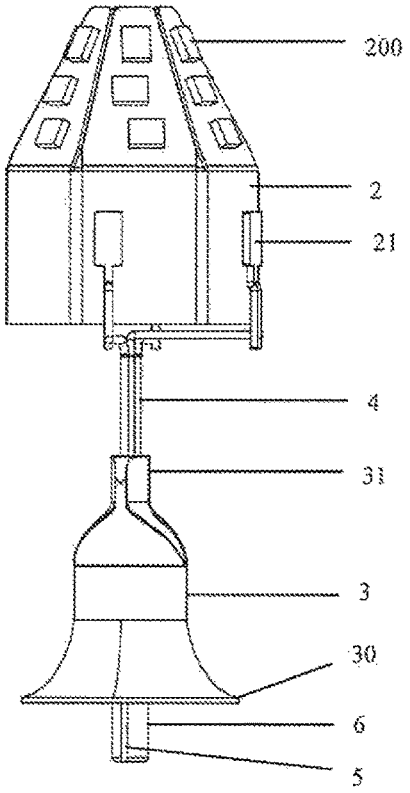
FIG. 3 is a front view showing the presence of a stem structure used in a BR-type glass bulb according to an embodiment of the present invention.

Furthermore, the three upper guide wires 4 correspond to the three pin needles 21 respectively, and are connected to the three pin needles 21 by a butt welding process. The pin needles 21 and the three upper guide wires 4 have a certain strength since they are made of special high-strength materials, and all of them are easy to weld, resistant to deformation and resistant to corrosion. The pin needles 21 and the three upper guide wires 4 may be in a straight shape or have two ends of different diameter or have one end with a fold goes upward, and all of the above arranges are made by a chip mounter. As shown in FIG. 3, two of the three pin needles are connected to a positive electrode and a negative electrode of the plurality of LED lamp beads 200 for electric conduction, and the remaining one of the three pin needles is electrically neutral for supporting the stem structure. In this case, when the stem structure is subject to external force, the substrate device 20 will not shake, and an interior of the substrate device 20 is hollow without any obstacles, such that noise will not be heard.

Furthermore, the number of the upper guide wires may be 4, and two of the four upper guide wires are connected to a positive electrode and a negative electrode of the plurality of LED lamp beads 200 for electric conduction, the two remaining upper guide wires 4 are disposed at the bottom of the substrate device 20, such that the stem structure becomes more firm and is not prone to get loose when subjected to an external force, and the pass rate is high during the mass production.

Figure 4:
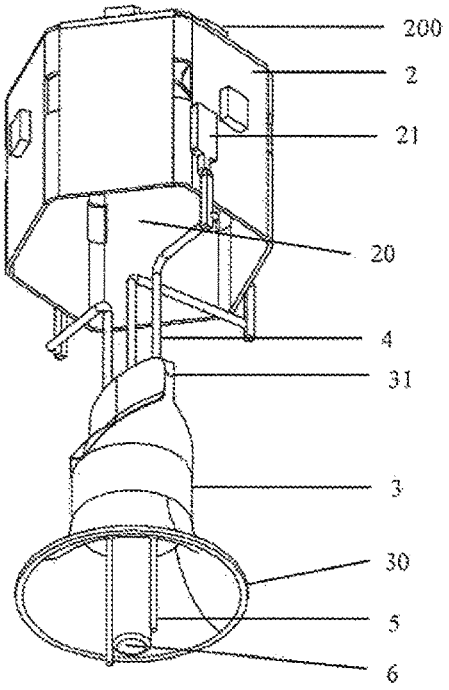
FIG. 4 is a schematic view showing an overall structure of a stem structure used in an A-type glass bulb according to an embodiment of the present invention.
Figure 5:
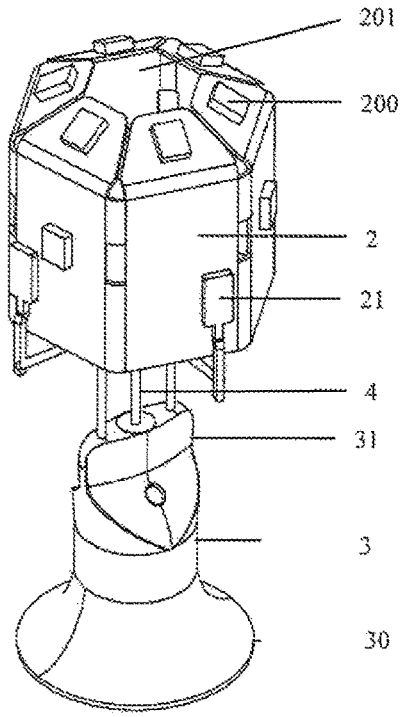
FIG. 5 is a top view showing the presence of a stem structure used in an A-type glass bulb according to an embodiment of the present invention.
Figure 6:
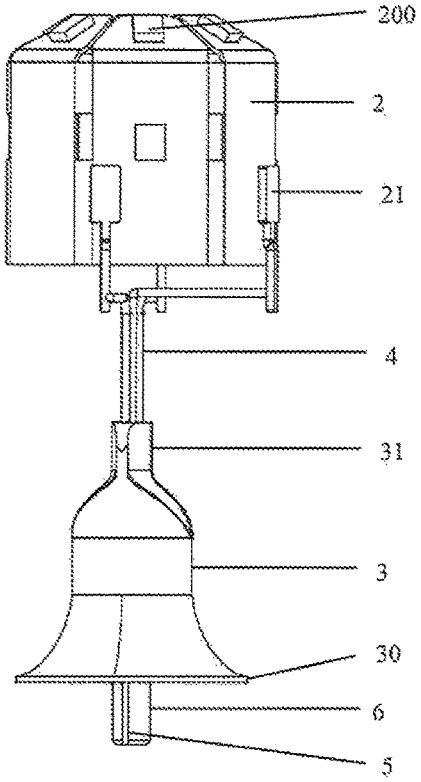
FIG. 6 is a front view showing the presence of a stem structure used in an A-type glass bulb according to an embodiment of the present invention.

Furthermore, the stem structures as shown in FIGS. 1, 2 and 3 are disposed inside the BR-type glass bulb, the stem structures as shown in FIGS. 4, 5 and 6 are disposed inside the A-type glass bulb, and such a stem structure described herein is also disposed inside the B-type glass bulb, or the ST-type glass bulb, or the G-type glass bulb or, the P-type glass bulb.

Figure 7:
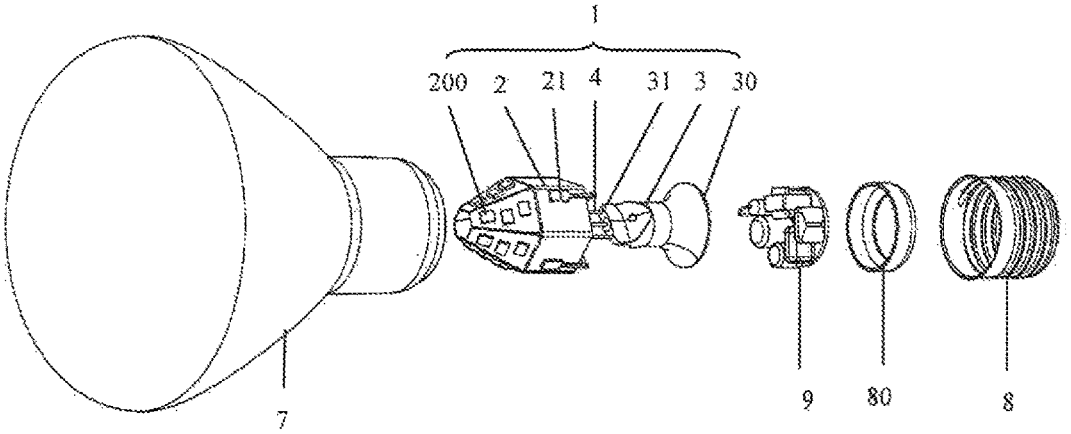
FIG. 7 is a schematic view showing an overall structure of an LED lighting device according to the present invention.

As shown in FIG. 7, the present invention further provides an LED lighting device comprising the above-mentioned stem structure 1, comprising:

a glass bulb 7, wherein a lamp head 8 is disposed at an opening of the glass bulb 7;

a driving circuit board 9 fixedly connected to the lamp head 8 with a collar 80, an input end of the driving circuit board 9 being electrically connected to the lamp head 8; and the stem structure 1, disposed inside the glass bulb 7, and configured to be electrically connected to an output end of the driving circuit board 9 through the lower guide wire 5.

In the above-mentioned technical solution for the LED lighting device, a lamp head 8 is disposed at an opening of the glass bulb 7, a collar 80 is arranged inside the lamp holder 8 for fixedly connecting to the driving circuit board 9, and an input end of the driving circuit board 9 is electrically connected to the lamp head 8, an output end of the driving circuit board 9 is electrically connected to the lower guide wires 5 of the stem structure 1, such that the LED lighting device is conducted. In this case, the LED lighting device applied to the stem structure 1 has a simple structure, a low price, and a high pass rate. Also, they can withstand a certain external force after molding.

In a preferred embodiment, the glass bulb 7 is designed such that the glass bulb is in the shape of an A-type glass bulb, or a B-type glass bulb, or an ST-type glass bulb, or a G-Type glass bulb, or a P-type glass bulb or a BR type glass bulb.

Figure 8:
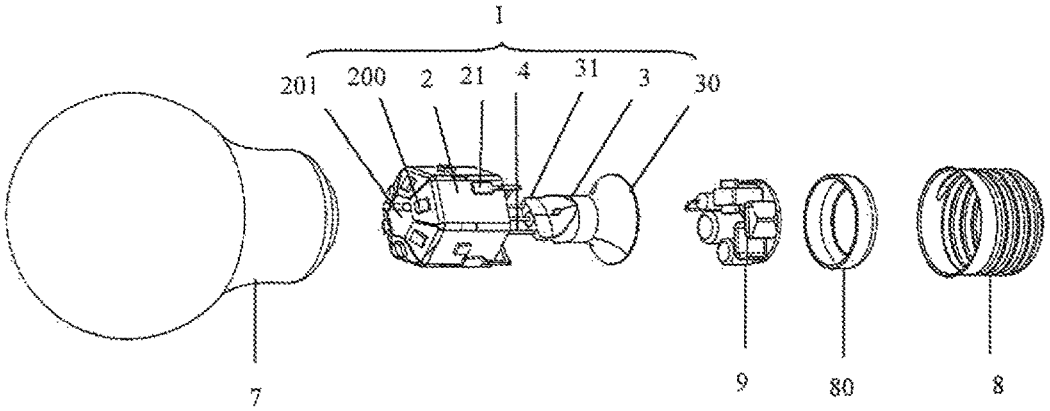
FIG. 8 is a view showing an overall structure of an LED lighting device with an A-type glass bulb.

Specifically, in this embodiment, the glass bulb 7 used in the above-mentioned stem structure 1 is designed to be in the shape of an A-type glass bulb as shown in FIG. 8, or is designed to be in the shape of a B-type glass bulb, or an ST-type glass bulb, or a G-Type glass bulb, or a P-type glass bulb, or a BR type glass bulb, as shown in FIG. 7. And the color of the glass bulb 7 may be clear color, milky white or amber color.

Furthermore, first of all, the plurality of LED lamp beads 200 and the three pin needles 21 are soldered to the substrate 2 by reflow soldering, then the substrate 2 is folded into a substrate device 20 in the form of a polyhedral structure manually or by an automatic bending equipment, and then the three upper guide wires 4 in the stem structure 1 are connected to any three pin needles 21 by a butt welding process.

Furthermore, the stem structure 1 and the glass bulb 7 are sintered together by sintering process, the glass tube 6 is connected to the interior of the glass bulb 7, so that air exhaustion and inflation is achieved through the glass tube 6. After the inflation is completed, the opening of the glass tube 6 is burned out until it is sealed, and a closed cavity filled with a protective gas composition is formed therein, so that various glass bulbs 7 comprising the above-mentioned stem structure 1 can be formed. Then the driving circuit board 9 is electrically connected. Finally, the lamp head 8 is installed, followed by application of welding mud powder. Then the whole LED lighting device is assembled.

The technical solution has the following advantages: providing a stem structure and an LED lighting device, wherein the stem structure and the LED lighting device have a simple structure, a low cost, a high pass rate, and they can withstand the external force.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A stem structure comprising:

a substrate, configured to be bent into a substrate device with an internal hollow structure, wherein a plurality of LED lamp beads and a plurality of pin needles are attached to a surface of the substrate device;

a horn mouth comprising a first wide mouth portion and a first narrow mouth portion opposite to the first wide mouth portion, the first narrow mouth portion being provided with a plurality of upper guide wires for connecting to the plurality of pin needles;

a plurality of lower guide wires, disposed inside the horn mouth, and configured to be connected to the plurality of upper guide wires through the first narrow mouth portion; and a glass tube disposed inside the horn mouth and attached to the plurality of lower guide wires.

2. The stem structure as claimed in claim 1, wherein the substrate device and the first wide mouth portion have a pad in a range from 28 mm to 55 mm.

3. The stem structure as claimed in claim 1, wherein the substrate device is a polyhedral structure having at least four surfaces, and an air convection hole is disposed on the top of the substrate device, wherein the plurality of LED lamp beads are evenly attached to side surfaces and a top surface of the substrate device.

4. The stem structure as claimed in claim 1, wherein the glass tube is integrally formed with the horn mouth, the plurality of upper guide wires and the plurality of lower guide wires by a sintering process.

5. The stem structure as claimed in claim 1, wherein the number of the upper guide wire is at least three.

6. The stem structure as claimed in claim 5, wherein the number of the plurality of pin needles is at least three, wherein two of the plurality of pin needles are connected to a positive electrode and a negative electrode of the plurality of LED lamp beads respectively, the remaining one of the plurality of pin needles which is not connected to the positive electrode and the negative electrode of the plurality of LED lamp beads is electrically neutral for supporting the stem structure.

7. The stem structure as claimed in claim 6, wherein the three upper guide wires correspond to the three pin needles respectively, and are connected to the three pin needles by a butt welding process.

8. The stem structure as claimed in claim 1, wherein the stem structure has a diameter in a range from 10 mm to 34 mm.

9. An LED lighting device comprising:

a glass bulb, wherein a lamp head is disposed at an opening of the glass bulb;

a driving circuit board fixedly connected to the lamp head with a collar, an input end of the driving circuit board being electrically connected to the lamp head; and a stem structure, disposed inside the glass bulb, and configured to be electrically connected to an output end of the driving circuit board through the lower guide wire, wherein the stem structure comprises:

a substrate, configured to be bent into a substrate device with an internal hollow structure, wherein a plurality of LED lamp beads and a plurality of pin needles are attached to a surface of the substrate device;

a horn mouth comprising a first wide mouth portion and a first narrow mouth portion opposite to the first wide mouth portion, the first narrow mouth portion being provided with a plurality of upper guide wires for connecting to the plurality of pin needles;

a plurality of lower guide wires, disposed inside the horn mouth, and configured to be connected to the plurality of upper guide wires through the first narrow mouth portion; and a glass tube disposed inside the horn mouth and attached to the plurality of lower guide wires.

10. The LED lighting device as claimed in claim 9, wherein the glass bulb is designed such that the glass bulb is in the shape of an A-type glass bulb, or a B-type glass bulb, or an ST-type glass bulb, or a G-Type glass bulb, or a P-type glass bulb, or a BR type glass bulb.

11. The LED lighting device as claimed in claim 9, wherein the substrate device and the first wide mouth portion have a pad in a range from 28 mm to 55 mm.

12. The LED lighting device as claimed in claim 9, wherein the substrate device is a polyhedral structure having at least four surfaces, and an air convection hole is disposed on the top of the substrate device, wherein the plurality of LED lamp beads are evenly attached to side surfaces and a top surface of the substrate device.

13. The LED lighting device as claimed in claim 9, wherein the glass tube is integrally formed with the horn mouth, the plurality of upper guide wires and the plurality of lower guide wires by a sintering process.

14. The LED lighting device as claimed in claim 9, wherein the number of the upper guide wire is at least three.

15. The LED lighting device as claimed in claim 14, wherein the number of the plurality of pin needles is at least three, wherein two of the plurality of pin needles are connected to a positive electrode and a negative electrode of the plurality of LED lamp beads respectively, the remaining one of the plurality of pin needles which is not connected to the positive electrode and the negative electrode of the plurality of LED lamp beads is electrically neutral for supporting the stem structure.

16. The LED lighting device as claimed in claim 15, wherein the three upper guide wires correspond to the three pin needles respectively, and are connected to the three pin needles by a butt welding process.

17. The LED lighting device as claimed in claim 9, wherein the stem structure has a diameter in a range from 10 mm to 34 mm.

* * * * *